US005566814A

United States Patent [19]

Hofele

[11] Patent Number: 5,566,814

[45] Date of Patent: Oct. 22, 1996

[54] PRESS, MULTISTATION PRESS OR SIMILAR FORMING MACHINE

[75] Inventor: Hans Hofele, Goeppingen, Germany

[73] Assignee: L. Schuler GmbH, Germany

[21] Appl. No.: 317,540

[22] Filed: Oct. 4, 1994

[30] Foreign Application Priority Data

Oct. 4, 1993 [EP] European Pat. Off. ..... 93115971

[51] Int. Cl.[6] ..... B65G 25/00

[52] U.S. Cl. ..... 198/621.1; 414/751; 72/405.16

[58] Field of Search ..... 198/621.1–.4; 414/751; 72/405, 405.13, 405.16

[56] References Cited

U.S. PATENT DOCUMENTS 4,133,199 1/1979 Shirao ..... 72/405
4,149,400 4/1979 Imanishi .
4,511,029 4/1985 Okawa ..... 198/621.2
4,540,087 9/1985 Mizumoto .

FOREIGN PATENT DOCUMENTS 0202882 11/1986 European Pat. Off. .

*Primary Examiner*—Joseph E. Valenza
*Attorney, Agent, or Firm*—Evenson, McKeown, Edwards & Lenahan P.L.L.C.

[57] ABSTRACT

A press, multistation press or similar forming machine, avoids space problems when a sheet bar loader is used in the inserting area of the press as a result of the movements of the transport rails in three axes. The length which is the result of the length of the transfer movement of the transport rails and the required length of the guiding devices on these rails is included in the length of the press-side guides on which the areas of the transport rails which are away from the driving area for the transfer movement are disposed in the direction of the transfer movement.

6 Claims, 2 Drawing Sheets

PRESS, MULTISTATION PRESS OR SIMILAR FORMING MACHINE

BACKGROUND AND SUMMARY OF THE INVENTION

The present invention relates to a press, multistation press or similar forming machine of this type.

The end areas of a press must perform the inserting of sheet bars and their removal after the shaping process. In this case, the drive of the transport rails for the transfer movement may be assigned to the removal area of the press. The removal may take place via a transport belt. The inserting takes place by a sheet bar loader which, as a result of its multiple tasks—separating of the sheet bars; cleaning and possibly aligning of these sheet bars; orienting and inserting of the sheet bars into a first station of the press may require a lot of space and expenditures in the inserting area of the press. In previous presses that use transport rails for transferring of the workpieces, the end sections of the transport rails extend, corresponding to the transfer lift, into the area of the sheet bar loader. As a result of the mutually advancing movement for the gripping of the workpieces and the transfer movement, a significant narrowing takes place with respect to the sheet bar loader.

U.S. Pat. Nos. 4,149,400; 4,540,087; and 4,630,461 show transport rails which extend into the area of the sheet bar loader and thus beyond the area of the initiating of the lifting/lowering movement and of the opening/closing movement. The presses shown in those patents all have solutions for the guiding of the transport rails, in which the length of the running rails caused by the length of the transfer movement is calculated into the moved part of the guide, thus into the transport rail. On the one hand, the transport rails must have a construction which is longer by this extent of the movement; on the other hand, there are the already mentioned space limitations for the sheet bar loader.

An object of the present invention is to overcome the above-mentioned problems so that the transport rails do not present a hindrance with respect to the sheet bar loader. Sheet bar loaders which have a different construction and therefore also corresponding dimensions may be used in the present invention.

This and other objects are achieved by the present invention which provides a press having a plurality of machining stations, comprising transport rails and holding devices on the transport rails. These transport rails provides a transfer movement of workpieces in the machining stations, the transport rails having guiding devices. First driving devices are coupled to the transport rails for applying the transfer movement in a first end area of the transport rails. Second driving devices are coupled to the transport rails for applying a lifting/lowering movement to the transport rails. Third driving devices are coupled to the transport rails for applying an opening/closing movement to the transport rails at the first end area and at a second end area of the transport rails. Guides are provided at the second end area of the transport rails on which the guiding devices of the transport rails run in a transfer movement direction. The guides have a length that is a function of the length of the transfer movement of the transport rails and of the length of the guiding devices.

Special advantages are obtained with the present invention because the actual guide rails or guide surfaces do not move along into the transfer device.

Other objects, advantages and novel features of the present invention will become apparent from the following detailed description of the invention when considered in conjunction with the accompanying drawings.

DETAILED DESCRIPTION OF THE DRAWINGS

Figure 1:
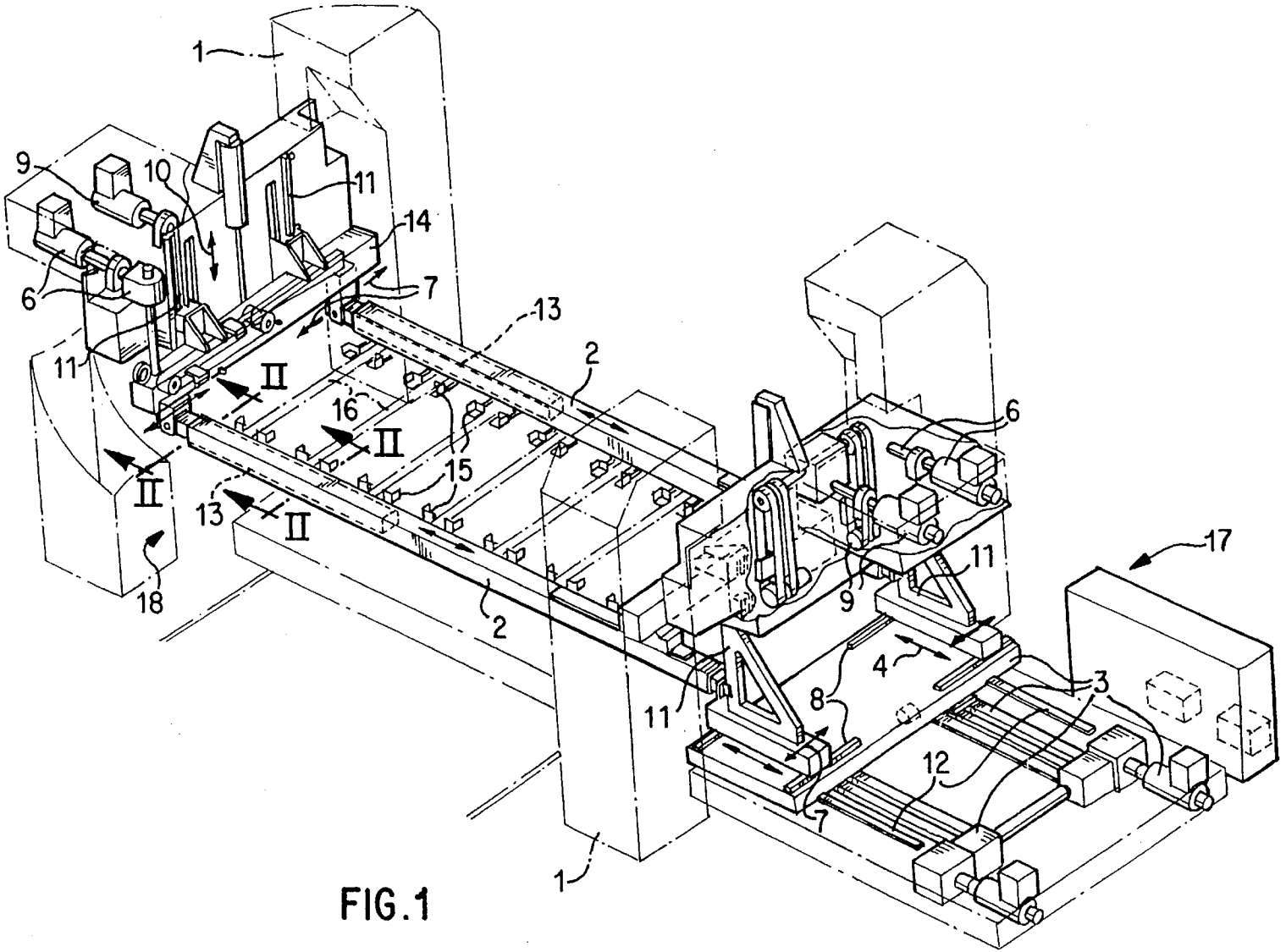
FIG. 1 is a view of a partial section of a press with the devices for the transfer movement of the workpieces, constructed according to an embodiment of the present invention.

Four press stands 1 of the press are illustrated with the devices mounted on them that provide for the lifting and lowering movements and for the tensioning and releasing movements of transport rails 2. Reference number 3 indicates generally all devices for the generating (motor), for the transfer (gear, toothed belt), and for the implementing (carriage, guides) of the transfer movement 4 of the transport rails 2. In each area of a pair of press stands 1, driving devices 6 are mounted for an opening/closing movement and driving devices 9 are mounted for the lifting/lowering movement of the transport rails 2. These devices act via gears, toothed racks or similar devices upon the transport rails 2 which are horizontally and vertically disposed in rails 8, 11 or 12. The transfer movement has the reference number 4; the opening/closing movement has the reference number 7; the lifting/lowering movement has the reference number 10. In various forms, the devices for these movements are sufficiently known from the state of the art so that these devices do not have to be discussed in greater detail.

Figure 2:
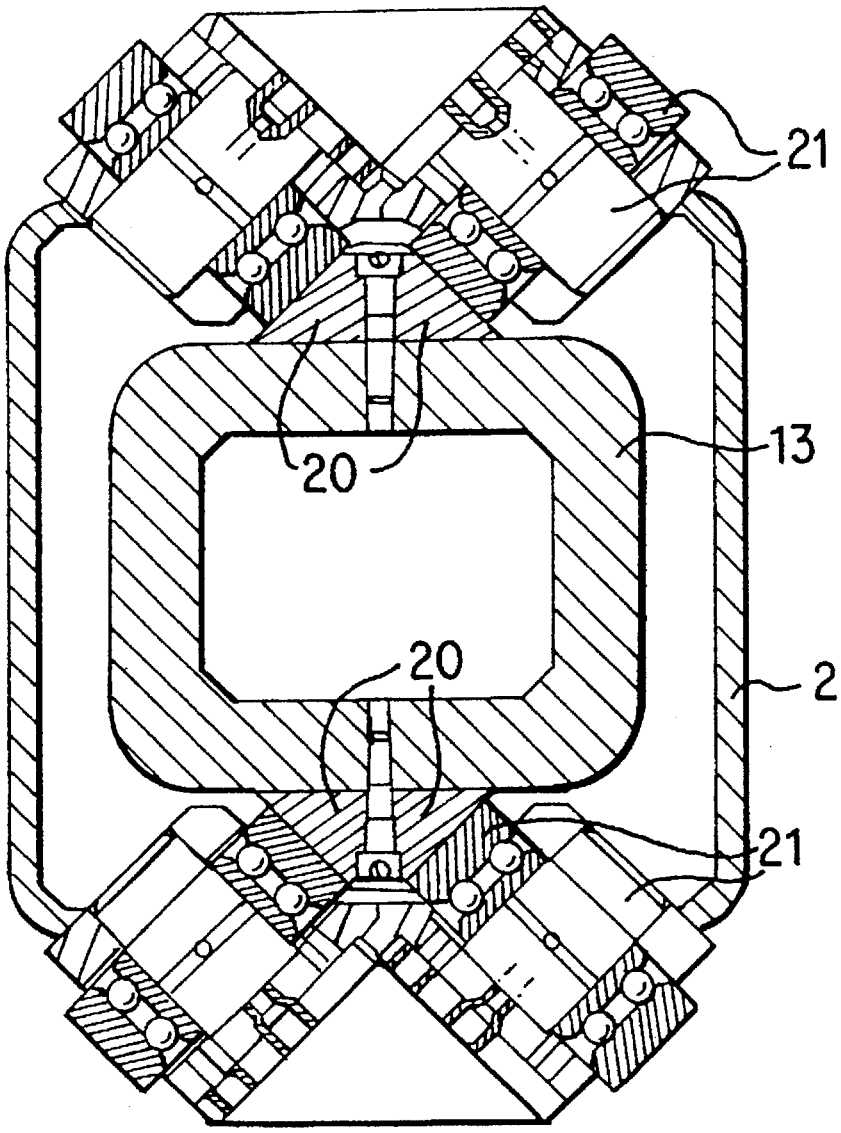
FIG. 2 is a cross-sectional view of a transport rail and a guide in the area of the sectional view II—II.

The area of the transport rails 2 which is assigned to the drive for the transfer movement has the general reference number 17. In the area 18, which is remote from the driving area 17, the transport rails 2 are disposed on or in guides 13. The guides 13 can be displaced on a transverse part 14 in guide strips, as indicated by reference number 8 in area 17, in opening and closing movements by means of the driving motor 6. The transverse part 14, as a whole, can be lifted and lowered in guide strips 11 by the driving motor 9. The transport rails 2 are provided with holding devices, such as grippers 15 or suction bars 16 for the gripping and holding of workpieces through the machining stations. (The suction bars 16 are only outlined as a variant.) The length of the guide 13 for the transport rail 2 is adapted to the length of the transfer movement plus the required length of the guide or guiding devices on or in the transport rail 2. According to the double sectional view II—II in FIG. 1, two guiding devices are provided whose arrangement and construction are illustrated in FIG. 2 in a preferred embodiment.

In this illustrated embodiment, the guide 13 is an interior part; the transport rail 2 is an exterior part. The running rails or running strips 20 are mounted on the guide 13. The transport rail 2 has rollers 21 forming opposing rolling devices which run on these running rails or running strips 20. The guides 13 as well as the transport rails 2 may be suspended in an articulated manner in hinge bearings or in ball socket bearings or similar devices. The moving drive in the three axes shown here, may take place at the bearings via a discrete motor control and guided by cams. In this embodiment, the length of the guide strips 20 on the guides 13 is the result of the length of the transfer movement of the transport rods 2, the length of the roller devices, such as the pairs of rollers 21 in the sectional areas II—II, and possibly a selectable overmeasure.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A press having a plurality of machining stations, comprising:

transport rails and holding devices on the transport rails, said transport rails providing a transfer movement of workpieces in the machining stations, the transport rails having guiding devices;

first driving devices coupled to the transport rails for applying the transfer movement in a first end area of the transport rails;

second driving devices coupled to the transport rails for applying a lifting/lowering movement to the transport rails;

third driving devices coupled to the transport rails for applying an opening/closing movement to the transport rails at the first end area and at a second end area of the transport rails;

guides at the second end area of the transport rails on which the guiding devices of the transport rails run in a transfer movement direction, wherein the guides have a length that is a function of the length of the transfer movement of the transport rails and of the length of the guiding devices, wherein each of the transport rails, at the second end area is disposed on one of the guides so as to be displaceable in the transfer movement direction, wherein each of the guides is movably disposed for the lifting/lowering movement and the opening/closing movement and is provided with running rails extending in the transfer movement direction, the running rails having lengths that are larger than the length of the transfer movement of the transport rails, the second end areas of the transfer rails being moved into a linking area of the guides when the transfer movement is carried out.

2. A press according to claim 1, further comprising guide strips for the opening/closing movement that are moveable with a transverse part arranged horizontally and transversely to the transfer movement, and the transverse part is disposed so as to be moveable with the guides in the lifting/lowering movement.

3. A press according to claim 1, wherein each transport rail is an exterior part that is pushed telescopically on the guides, which serve as an interior part, and the running rails and the guiding devices are arranged between each transport rail and each guide.

4. A press according to claim 1, wherein the running rails on the guides are situated opposite at least one of sliding and rolling devices on the transport rails that serve as opposite guiding devices.

5. A press according to claim 1, wherein the guiding devices inserted in the transport rails are applied above and below to running surfaces of the guides.

6. A press according to claim 5, wherein one set of the guiding respectively is inserted in the second end area of each transport rail, and one set of guiding devices respectively is inserted in an area in or on each transport rail at a distance from the second end area.

* * * * *